United States Patent [19]

Briggs et al.

[11] 4,151,876

[45] May 1, 1979

[54] SINGLE STRING RETRIEVABLE WELL PACKERS

[75] Inventors: Wayne S. Briggs, Arlington; Dennis M. Spriggs; Stanley A. Weise, both of Dallas, all of Tex.

[73] Assignee: Dresser Industries, Inc., Dallas, Tex.

[21] Appl. No.: 844,559

[22] Filed: Oct. 25, 1977

[51] Int. Cl.[2] ..... E21B 23/06; E21B 33/124; E21B 33/129

[52] U.S. Cl. ..... 166/134; 166/182; 166/217

[58] Field of Search ..... 166/120, 123, 134, 217, 166/216, 182, 138

[56] References Cited

U.S. PATENT DOCUMENTS

| | | | |
|---|---|---|---|
| 3,548,936 | 12/1970 | Kilgore | 166/216 |
| 3,714,984 | 2/1973 | Read | 166/134 |
| 3,749,166 | 7/1973 | Young | 166/134 |
| 3,797,572 | 3/1974 | Mignotte | 166/134 |
| 3,818,987 | 6/1974 | Ellis | 166/134 |
| 4,008,759 | 2/1977 | Blackwell | 166/120 |

*Primary Examiner*—James A. Leppink
*Attorney, Agent, or Firm*—Richard M. Byron

[57] ABSTRACT

A single string well packer having a pair of unitary tubular gripping members is disclosed which can be set by wireline, hydraulic pressure, or mechanically on tubing string.

11 Claims, 12 Drawing Figures

SINGLE STRING RETRIEVABLE WELL PACKERS

BACKGROUND OF THE INVENTION

This invention relates generally to oil well packers and more particularly discloses a single string well packer which is settable through a multitude of various functional modes and ranges.

Normally, a well packer is used in oil and gas operations to seal a zone above the packer from a zone below the packer in a well bore. For example, after a well casing has been set and the well has been logged, a packer is then lowered into the well and located at a selected depth. For a casing perforating operation and testing of a zone spanned by a particular stratum, one packer may be positioned at the top of the zone and another well packer may be positioned at the bottom of the zone. This isolates the zone for testing and production after perforation. Packers are likewise used in cementing and fracturing operations to isolate the zone of interest.

The types of well packers in general use today are usually restricted to a mechanical set packer, a hydraulic set packer or a wireline set packer. One of the primary requirements of a satisfactory well packer is that the packer may be placed in a desired location and selectively set into strong gripping and sealing engagement across the casing diameter so that the packer may support the pressure above and/or below the packer and in some instances, support the weight of a tubing string.

Another primary qualification of a good well packer is that the packer is easily movable in the well casing without premature setting of the gripping members or the elastomeric packer elements before the desired zone is reached. Likewise, a preferable characteristic of a good well packer is that the packer has easy and predictable retrievability to prevent having to mill out the packer when an open casing is desired.

One particular well packer which has been utilized effectively under the conditions above is that disclosed in U.S. Pat. No. 3,714,984 to Read and assigned to the assignee of the present invention. This packer utilizes two unitary tubular gripping members to grip the well casing and provide longitudinal compression of the elastomeric elements to force them into radial expansion and sealing engagement against the casing wall.

A second patent, U.S. Pat. No. 3,818,987, to Ellis and assigned to the assignee of this invention discloses a well packer which has a selectively retrievable feature making it particularly advantageous for use under many well conditions.

A third well packer is disclosed in U.S. Pat. No. 3,804,164 to Ellis and assigned to the assignee of the present invention. The third packer utilizes a pair of unitary tubular gripping members and further features a hydraulic setting mechanism associated therewith.

Other U.S. Pat. Nos. such as 3,731,740 to Douglas and 3,548,936 to Kilgore et al also disclose well packers utilizing unitary tubular gripping members and having setting mechanisms falling within either hydraulic, wireline, or mechanical ranges. The present invention is thus an improvement over the above noted patents in that it provides all of the features and advantages found therein plus the additional desirable features of a preset indicating function and the ability to take up from both directions. In addition to these additional advantages, the mechanically set version of this invention offers an additional feature of having a shearably mounted upper gripping member.

The ability to take up from both directions is advantageous in that pressure above or below the tool generates forces which are carried through the upper and lower gripping members respectively and increases the compressive force on the packing element, thereby increasing its sealing effectiveness. The prior art packers are adapted to take up in one direction only and pressure occurring from the opposite direction in the well bore tends to decompress the packing element and lower its sealing effectiveness.

The preset indicator function provides a means when going in the hole in the mechanical set orientation to determine if the tool has inadvertently begun to prematurely set while running in the hole. In a premature set, the downward movement of the tubing string into the borehole may cause the packer to enter a series of irreversible steps such that the packer may not be subsequently lowered or raised in the well until it has been completely set, retrieved, and redressed at the surface. Redressing involves replacing the frangible elements and any damaged seal rings or packer elements.

The present invention avoids the premature set by the provision of a preset indicator function which involves a rotation of the upper slip into engagement in the well bore with a subsequent pause before setting of the remaining packer assemblies occurs. The indication of the weight indicator at the surface discloses that the setting operation has begun and gives sufficient time to reverse the direction of the tubing travel in the well bore before the irreversible portion of the setting operation has begun.

Thus, the present invention discloses a single string well packer utilizing dual unitary tubular gripping members, which well packer offers the advantage of full versatility in setting operations, full retrievability, and the advantages of a preset indicator and take-up from both directions.

DESCRIPTION OF THE PREFERRED EMBODIMENTS

Figure 1A:
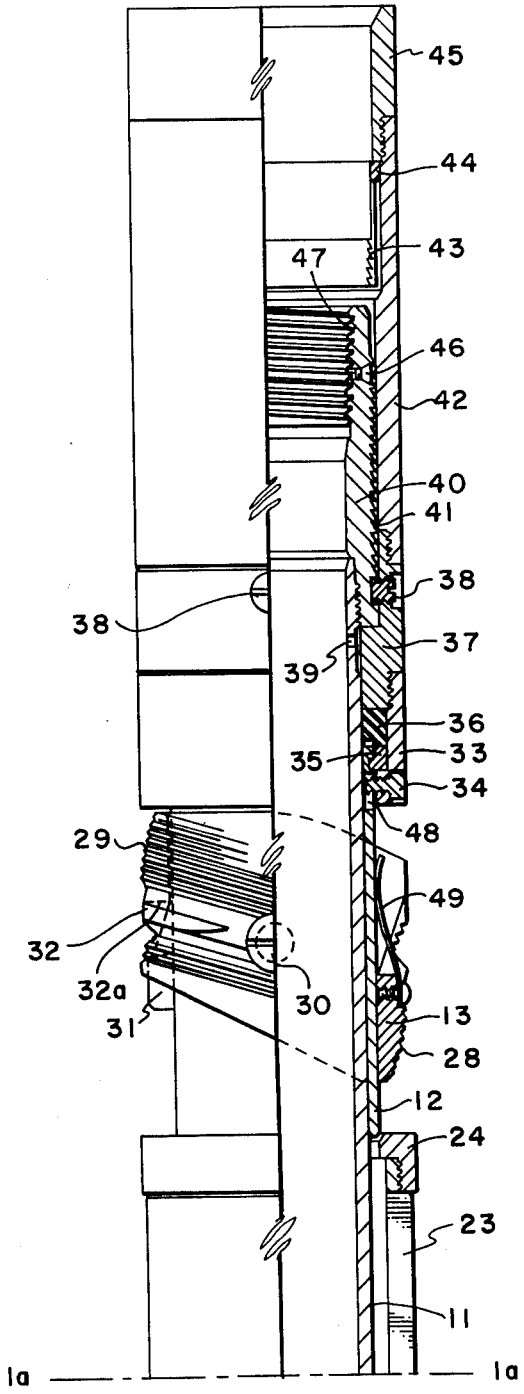
FIG. 1 is a partial cross-sectional illustration of the packer of this invention in its unset condition and in the wireline setting mode.

Referring now to FIG. 1, the wireline set well packer 10 is illustrated in partial cross-sectional view. The packer assembly generally comprises five telescopic and sliding sub-assemblies generally consisting of an inner mandrel assembly, including packer mandrel 11, an upper slip assembly, an upper packer assembly, a lower packer assembly and a lower slip assembly.

The inner mandrel assembly generally comprises an elongated tubular cylindrical mandrel 11 having threadedly attached at the top thereof a cylindrical latch sleeve 40 with latch teeth 41 located externally and threads 47 located internally. A plurality of peripheral flow ports 39 pass through the wall of the mandrel 11 near the upper end thereof. An annular abutment shoulder 64 is formed externally on the wall of mandrel 11.

At the lower end of mandrel 11, a bottom collet sleeve 59 is threadably attached having a plurality of collet fingers 60 extending downwardly therefrom. Collet fingers 60 are formed by longitudinal slots formed through the wall of the bottom half of collet sleeve 59 and the fingers have external threads machined thereon. Collet fingers 60 are maintained in an outwardly expanded direction by the location of a retrieval mandrel 61 located slidably within sleeve 59.

The upper slip assembly generally comprises a lead-in collar 45 threadably attached to a latch housing 42 which in turn is threadedly connected to a setting sleeve 37. Below sleeve 37 and connected therewith is a slip abutment collar 33 having a number of bolts 34 extending therethrough into the slip carrier sleeve 12.

A lock ring 35 is located between collar 33 and sleeve 12 and engages in a peripheral groove formed in sleeve 12. An annular rubber spring 36 is held entrapped between lock ring 35 and setting sleeve 37. A unitary tubular gripping member 13 is shearably attached to carrier sleeve 12 by a pair of laterally opposed shear pins 30. Gripping member 13 has external gripping teeth 28 and 29 formed at diametrically opposed ends thereon.

A leaf spring 49 is attached to member 13 and abuts sleeve 12 to continuously bias member 13 in a radially inward non-gripping orientation. A slot 32 having an upper abutment shoulder is formed in one side of gripping member 13 and has slidably engaged therein an unsetting lug 31 formed on sleeve 12 and extending radially outward inside slot 32. The upper abutment shoulder **32*a* of slot 32 is arranged to be contacted by shoulder 31 and pivot gripping member 13** inward in the non-gripping position illustrated. This construction is provided for unsetting of the packer when it is to be removed from the well bore.

The upper packer assembly generally comprises an upper guide ring 24 attached to a guide cylinder 21 which in turn is connected to an upper packer head 19 and a cylindrical packer sleeve 16. A plurality of elastomeric packer elements 17 separated by metallic packer rings 18 are located concentrically and slidably on packer sleeve 16.

The lower packer assembly generally consists of a lower packer head 20 slidably mounted on sleeve 16 and prevented from downward movement off of sleeve 16 by abutment with a raised annular shoulder **16*a* formed near the bottom of sleeve 16. Head 20 is in sliding abutment with the lowermost packer element 17 and has threadedly attached at the bottom thereof a lower spacer 25 having one or more ports 26** formed through the wall thereof.

The bottom of the lower packer assembly is made up of a bottom ring 27 threadedly connected to spacer 25 and having an inner abutment shoulder **27*a* projecting inwardly for limiting abutment against slide limit ring 51 held in an external groove formed in mandrel 11. A second abutment shoulder 27*b* is formed near the top of ring 27 for abutment with the bottom end of sleeve 16**.

The lower slip assembly generally comprises a bottom connector 63 to which is threadedly connected thereabove the lower guide cylinder 56 having a connector ring 55 attached at the top. Threadably connected to ring 55 is a lower housing 52 connected by a plurality of shear pins 53 to a lower slip carrier sleeve 14.

A guide pin 58 is threadably engaged in collet sleeve 59 and projects radially outward into a longitudinal guide slot 57 formed in the wall of guide cylinder 56. Likewise, in the upper packer assembly, a guide pin 22 is threadably engaged in mandrel 11 and projects radially outward into longitudinal guide slot 23 formed through the wall of guide cylinder 21.

A rubber spring 54 similar to spring 36 is located in resilient abutting arrangement between connector ring 55 and the bottom end of carrier sleeve 14. A lower gripping member 15 comprising a unitary tubular member is pivotally attached to carrier sleeve 14 by a pair of laterally opposed pins **15*a*. Gripping member 15 is generally similar in construction to member 13 but is oriented in an inverse position from slip 13**.

In typical operation, the well packer embodied in FIG. 1 is located on a wireline setting tool (not shown) which is attached at threads 47. The setting tool has an inner sliding assembly which is threadably attached by threads 47 to latch sleeve 40 and inner mandrel 11. The setting tool which is commercially available and well known in the art has an external housing which is in abutment with the upper end of lead-in collar 45. Normally, the setting tool utilizes an explosive charge to slide its inner housing with respect to the setting tool outer portion. This initially provides a relative telescoping movement between inner mandrel assembly 11 and the upper slip assembly.

The setting movement is to drive the upper slip assembly downward by abutting collar 45 and then moving the inner mandrel assembly upward.

As a result of the downward movement of collar 45, gripping member 13 will rotate outward on pins 30 until the toothed sections 28 and 29 engage the well bore casing in biting gripping engagement. The inner mandrel assembly and outer assemblies move as a single unit until pins 50 are sheared by continued application of telescopic force from the setting tool. Since the lower slip assembly is connected to the inner mandrel assembly by collet sleeve 59 and fingers 60, when the inner mandrel assembly begins moving upward, the lower slip assembly moves upwardly simultaneously. The abutment of lower gripping member 15 with the lower packer assembly tends to move the lower and upper packer assemblies simultaneously upward with mandrel 11. This results in a telescoping of carrier sleeve 12 inside guide cylinder 21 until guide ring 24 abuts the lowermost edge of gripping member 13.

Continued upward movement of the outer assemblies with respect to the inner mandrel assembly then is retarded by the engagement of the upper gripping member 13 so that continued upward forces applied to the lower slip assembly compresses the elastomeric elements 17 by moving the lower packer assembly towards the upper packer assembly which is in immovable abutment with the upper gripping member 13.

Simultaneously with compression of the elastomeric elements 17 in a longitudinal orientation, elements 17 will be expanded radially outward into sealing engagement with the well bore casing inner wall. Also, simultaneously with the outward expansion of elements 17 is the latching engagement of internally threaded collet fingers 43 on the matching external threaded section 41 of latch sleeve 40. A third simultaneous operation progresses during the above mentioned compression and latching steps and consists of pivotal movement of lower gripping member 15 by the abutment of bottom ring 27 with the uppermost portion of gripping member 15 thereby pivoting the toothed sections of member 15 outward into biting engagement with the well casing.

Upon completion of the telescopic action between the inner and outer assemblies, the upper gripping member 13 has been pivoted into tight gripping engagement in the well bore, the elastomeric packer elements 17 have been radially expanded into tight sealing engagement with the well bore and the lower gripping member 15 has been pivoted into tight gripping engagement with the well bore maintaining the tightly compressed condition of elements 17.

Any additional upward or downward forces in the well bore arising from well pressure or weight on the packer serves to further telescope the inner mandrel within the outer assemblies thus further engaging the upper and lower gripping members and compressing the elastomeric packer elements. The telescopic action is irreversible due to the latching action of collet fingers 43 on the matching threaded portion of latch sleeve 40. The angle of the teeth on fingers 43 and tooth section 41 is arranged to allow downward sliding movement of teeth 43 on teeth 41 while preventing relative upward movement of teeth 43 on teeth 41.

Thus, movement of the inner mandrel assembly is allowed in one direction only with respect to the outer assemblies and this direction is the one that results in further compression of the elastomeric elements and tighter rotation of the gripping members.

When it is desirable to retrieve the well packer, it is obvious that the latching of collet 44 on sleeve 40 is irreversible and the reverse telescopic action of the inner and outer assemblies must be achieved at the opposite end of the well packer. This is done by lowering a retrieving tool into retrieval mandrel 61 and engaging in a locking channel 62. Upward movement of the retrieving tool then shears a set of frangible pins or a shear ring which previously held mandrel 61 tightly in sleeve 59. Mandrel 61 is then moved upward until it abuts an inner projecting shoulder formed in sleeve 59.

This allows a relief area 65 formed in the outer wall of mandrel 61 to become aligned with collet fingers 60. Further upward movement of retrieval tool 61 in abutment with sleeve 59 then wedges fingers 60 inward into relief area 65 by the sliding wedging action of the angled faces of the matching teeth on the external surface of fingers 60.

Continued upward movement of the retrieval tool moves mandrel assembly 11 upward, lifting abutment collar 33 from the top of member 13 until shoulder 64 abuts the bottom of slip carrier 12. Then continued upward force shears pins 30 and moves unsetting lug 31 into shoulder 32*a* resulting in unsetting and retraction of member 13.

Thereafter, shoulder 64 contacts the inner shoulder of guide ring 24 in the upper packer assembly, lifting the packer assembly upward and relaxing the elastomeric packer elements. Abutment ring 27 moves up off of gripping member 15. Housing 52 then abuts the lower cammed surface of member 15, rotating the member into the non-gripping orientation illustrated, and the packer is free for removal from the well.

Thus, the advantages of the present invention can be discerned from the above description, i.e., a well packer utilizing a pair of tubular gripping members which respond to normal unsetting forces by further tightening their grip in the well casing; also, a well packer which responds to upward or downward forces thereon by further telescopic action resulting in tighter setting of the gripping members and of the sealing element while simultaneously preventing any outward telescoping motion tending to release or relieve the setting forces. This advantage is commonly termed "taking up in both directions." Also, of distinct advantage in this embodiment is the provision of a selective retrieving assembly in the well tool which allows the retrieval of the packer at the desirable time. The invention also provides a latching mechanism arranged to prevent reversing of the telescopic action which sets the packer while allowing the telescopic setting action to occur in one direction.

Figure 1B:
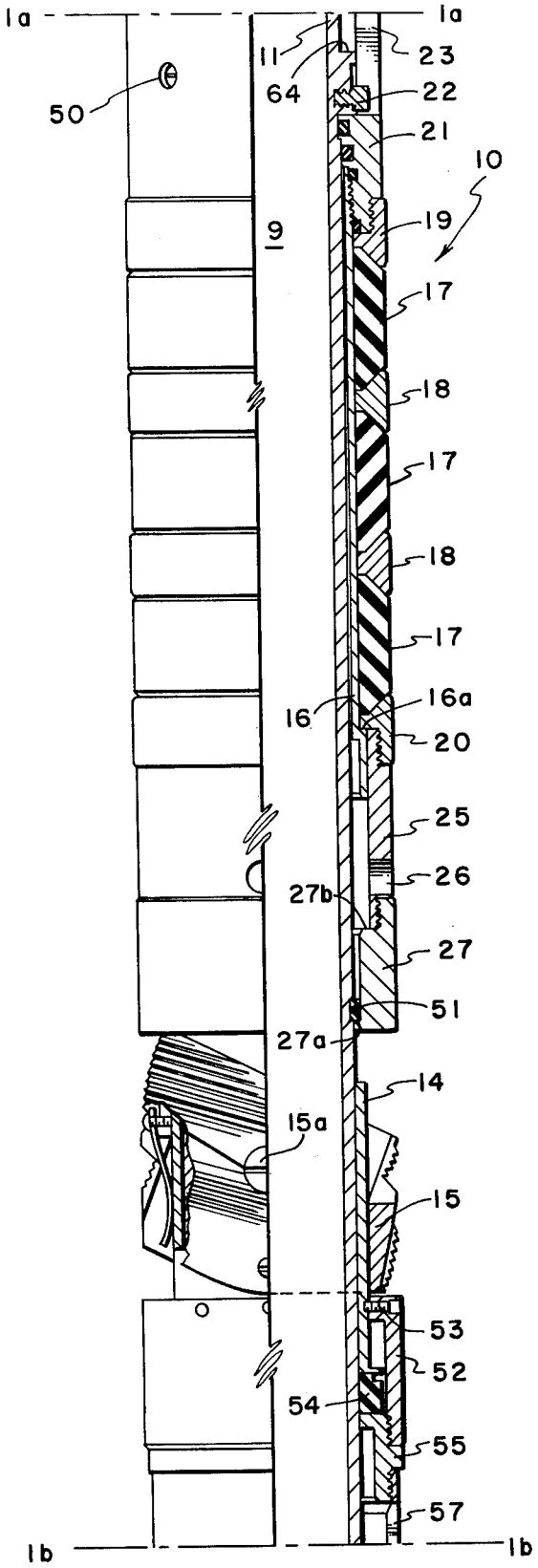
Figure 1C:
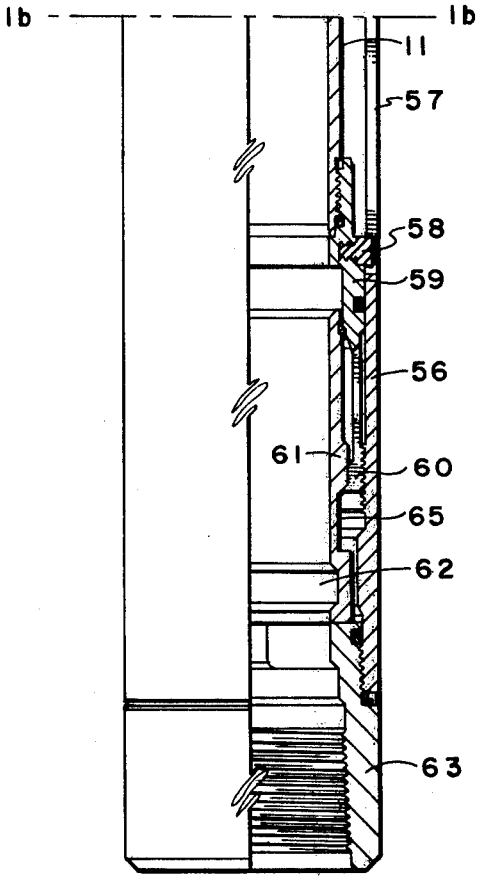
Figure 2:
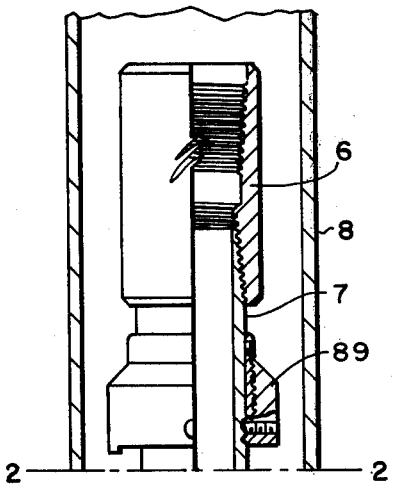
FIG. 2 is a partial cross-sectional view of the well packer in a set orientation in the casing and in the mechanical setting mode.
Figure 2E:
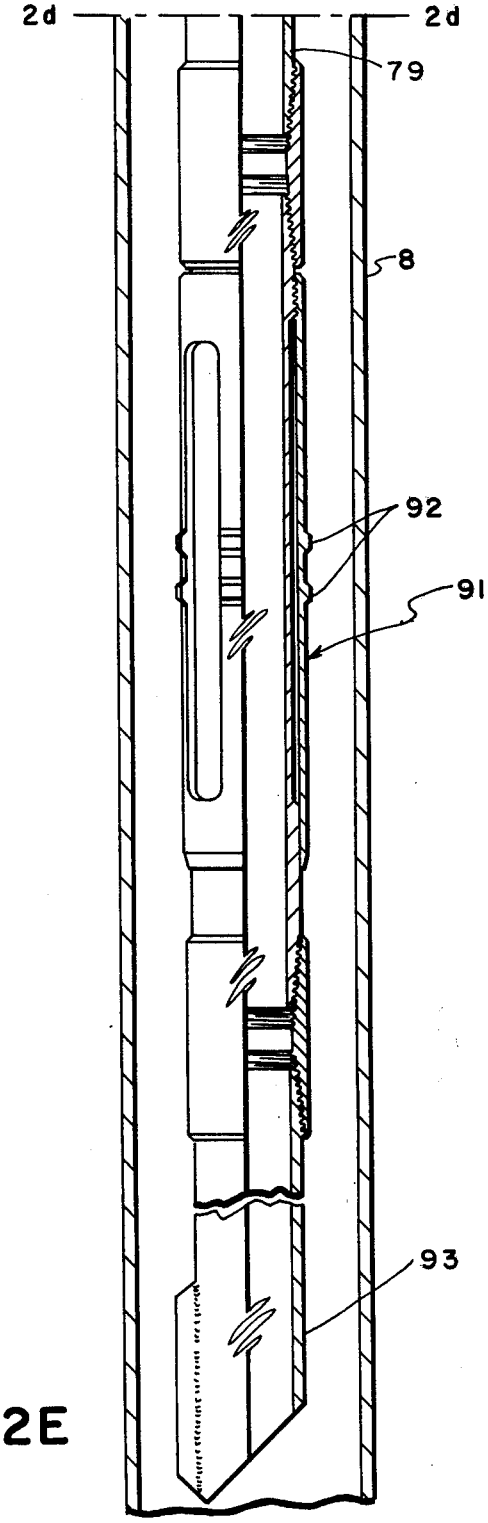
Figure 2A:
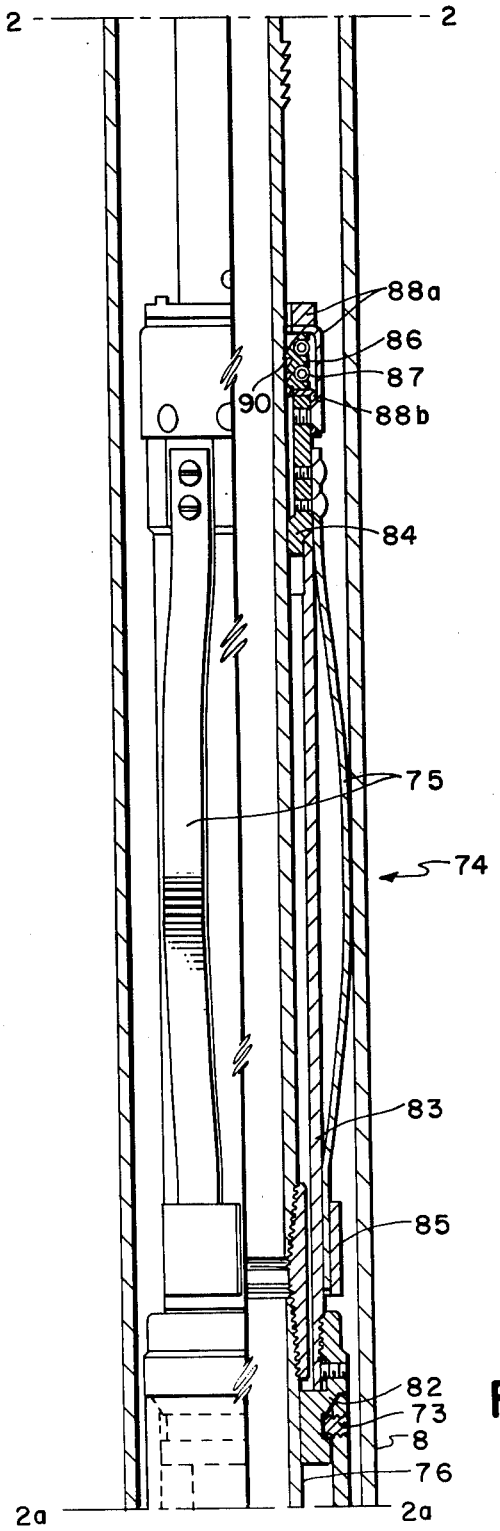
Figure 2B:
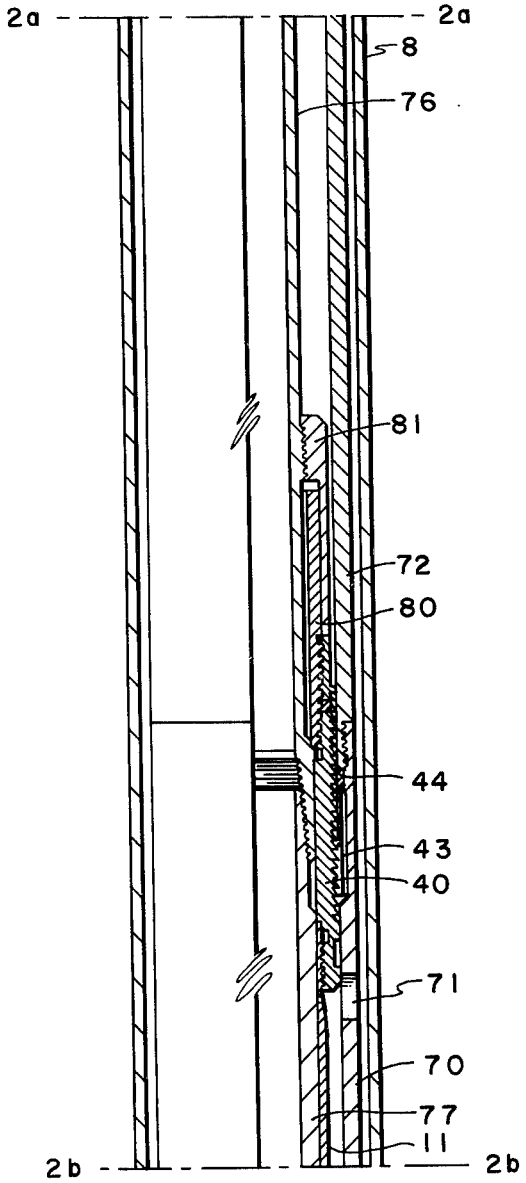
Figure 2C:
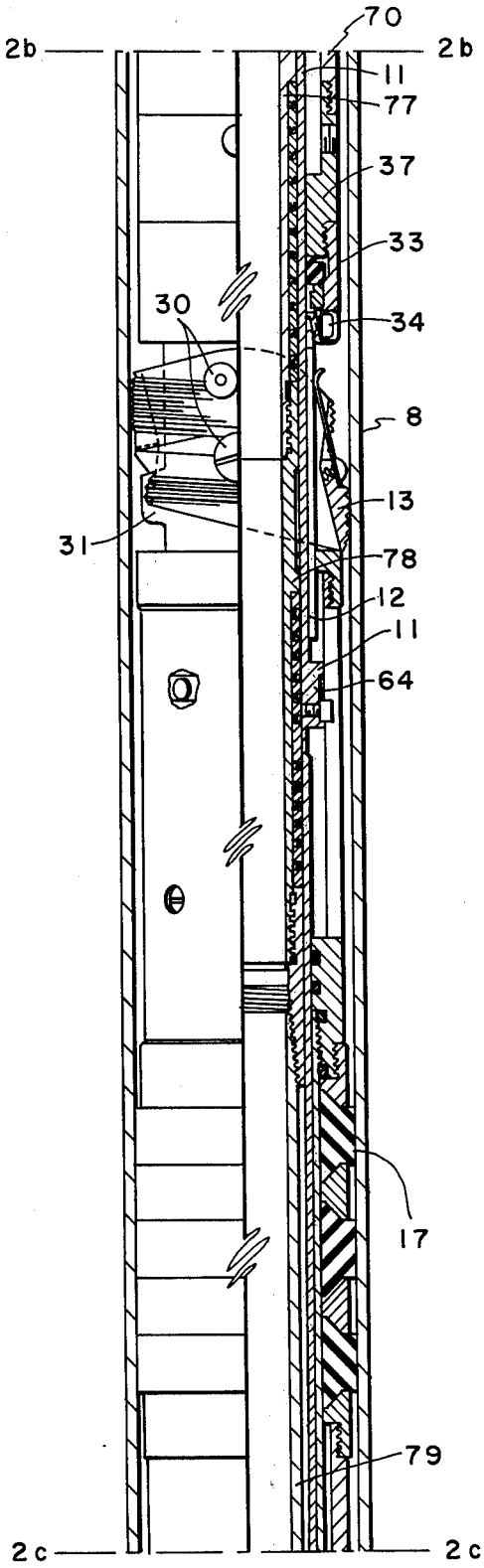
Figure 2D:
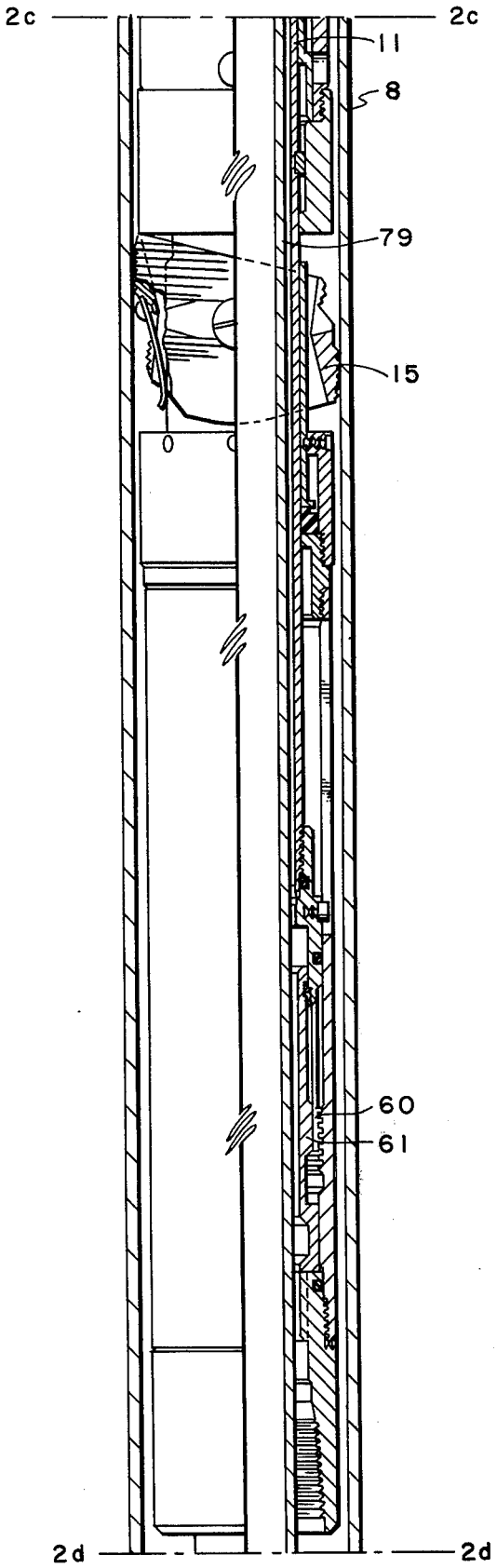

FIG. 2 illustrates a second embodiment of the invention shown in partial cross-sectional elevational view. In FIG. 2, the packer assembly of FIG. 1 has been altered to provide mechanical setting of the packer in the well bore. This modification consists of substituting new elements from setting sleeve 37 upward.

Attached to the upper end of sleeve 37 is a tubular latch housing 70 having a port 71 through the wall thereof. At the upper end of housing 70 is threadedly attached a lead-in collar 72 having a latch collet sleeve 43 held therein with engaging teeth located internally as previously described in FIG. 1. The inner mandrel assembly 11 of FIG. 2 is substantially identical to the corresponding mandrel in FIG. 1.

A mechanical setting assembly 74 is located atop the packer and connected thereto by means of latch sleeve 40. The setting assembly generally comprises a plurality of bow springs 75 for frictional engagement with the well bore casing. The bow springs 75 are attached to a housing 83. The housing 83 is slidably located on a tubular setting mandrel 7 which in turn is threadedly connected to the lower end of a normal tubing string (not shown) by a standard threaded collar 6.

The setting mandrel 7 has a set of external latch teeth 90 formed thereon and has at its lower end a lower mandrel 76. A bottom connector 82 encircles lower mandrel 76 and is threadedly attached to the lower end of housing 83. A retainer sleeve 85 is slidably located around the lower ends of bow springs 75 in such a manner to retain the springs in close proximity to housing 83 while allowing inward and outward flexing of the bow portion of the springs. The springs are retained at their upward ends by bolts threaded into the spring collar 84.

A set of latch plates 86 are held in alignment between upper cup 88*a* and lower cup 88*b*. Lower cup 88*b* has upward projecting fins (not shown) between plates 86 to prevent rotation of the plates in the cups. Plates 86 have helical internal latching teeth and are resiliently retained in sliding abutment against setting mandrel 7 by a pair of looped coil springs 87. The teeth 90 internally formed in plates 86 are adapted to match the helical teeth formed externally on mandrel 7 and further adapted to allow longitudinal sliding movement therebetween in one direction only. The teeth are arranged in this instance to allow downward movement of the mandrel 7 inside latch plates 86 until top ring 89 abuts latch cover 88.

In typical operation, the embodiment of illustration 2 is located at the lower end of a tubing string by threadedly engaging collar 6 thereon. The setting assembly and packer assembly are lowered into the borehole as a single unit. As the friction springs 75 contact the casing wall, the outer portion of the setting assembly 74 comprising the spring 75 and housing 73 will resist downward movement of the tubing string. This will result in downward movement of setting mandrel 7 inside the friction housing 83 until latch plates 86 are engaged with teeth 90 and abutment of latch cover 88 with ring 89 prevents further telescoping action therebetween. Continued downward movement of the lower mandrel 76 inside the well packer is prevented by the abutment of housing 81 with the top of latch sleeve 40.

When the packer is located in the well bore at the desired location, the string is rotated to unthread the helical teeth 90 from latch plates 86. The release of mandrel 7 from the friction mandrel 83 allows the tubing string to be pulled up through the friction assembly until the lower end of the upper gripping member is contacted by the upper ring 24. Upon the abutment of these two elements, setting of the packer assembly begins.

The inital step in the setting process is the preset step consisting of partially rotating the upper gripping member 13 into engagement with the casing wall. When the mandrel 7 has been pulled up through the friction assembly 83 until member 13 is abutted by ring 24, the further upward movement of mandrel 7 will pull upward on the lower packer assembly and the lower slip assembly, thereby rotating member 13 into gripping engagement with the casing wall.

At this point, the locking teeth 43 are still above the matching teeth on latch sleeve 40 and the spacing thereof is provided such that the member 13 becomes fully rotated into the set position before the latch teeth are engaged. Upon the full rotation of 13 against the casing wall, the operator at ground surface will notice from his weight indicator that a surge in resistance to upward movement of the tubing string has occurred due to the sudden increase in friction arising from the setting of member 13.

At this time, if the packer is not in the proper location, the operator has the ability to release the string, lower it back into the well bore and lower the packer to the desired location. If he desires to raise the packer in the well bore, the downward movement of mandrel 7 relatches teeth 90 in latch plates 86, releases the upper gripping member, and allows upward movement of the packer in the well bore.

Upon placement of the packer in the proper location, the above-mentioned steps are repeated, i.e., rotation to disengage threads 90 from plates 86 then raising of the tubing string in the packer assembly to engage member 13 and ring 24 and further lifting of the tubing string to set gripping member 13 and begin compression of the elastomeric elements 17 and rotation of member 15.

The provision of the preset indicator mechanism comprising the latch assembly 44, 43, and 40 is particularly advantageous because of residual torque introduced into the tubing string during making up of the string at the wellhead. The many hundreds of sections of tubing string are threaded together to form a single elongated string to extend down hole to the producing formation. The extended length of the string may reach ten thousand feet or more, thus providing an aggregate rotational elasticity in the string which can absorb a large amount of torque. This rotational energy stored in the string often during threading together of the tubing joints is released by rotation of the setting mechanism in the packer assembly at teeth 90 and plates 86. When this occurs prematurely and the packer is not properly located, the well operator will notice a surge in the weight indicated on his weight indicator which means to him that the gripping member 13 has been rotated into engagement with the casing wall and further upward movement of the tubing string will result in the irreversible latching of collet 43 on sleeve 40.

At any time prior to the downward movement of collet 43 over latch 40, the packer may be moved upward and downward in the well bore an indefinite number of times. Once the permanent setting of the packer is desired, extended upward pull on the tubing string will result in the aforementioned compression of elastomeric members 17 and a telescoping movement of members 13 and 15 toward each other to grip the casing and maintain the radial expansion of packer elements 17.

As previously mentioned with respect to the embodiment of FIG. 1, when it is desired to unset the packer it is achieved by the upward transfer of retrieval mandrel 61 to release the locking position of collet fingers 60. Retrieval of the packer then progresses similarly to the retrieval procedure previously described with respect to the embodiment of FIGS. 1*a*-1*c*.

The provision of shear pins to attach gripping member 13 to carrier sleeve 12 provides an additional function in the operation of the packer assembly. Normally, the gripping member 13 would be provided with an elongated slot in which the pin holding the member on the carrier sleeve would ride. This elongated slot would allow upward movement of the carrier sleeve during the unsetting operation through the gripping member to abut the unsetting lug with the abutment shoulder in the gripping member.

The slot arrangement would be unsuitable in this particular tool because of the friction of the collet fingers 43 on the latch sleeve 40. This friction could possibly become greater than the setting friction established by the bow springs 75 and would slide the setting assembly upward in the casing while attempting to set the packer rather than maintaining the upper slip assembly in a stationary position in the casing.

Thus, it is desirable to anchor the upper slip assembly in the casing prior to the engagement of latch fingers 43 on latch sleeve 40. Were the gripping member 13 to be provided with the normal unsetting slot about pivot pin 30, the upper slip assembly would not be anchored in the casing prior to the engagement of latch collet 43 on sleeve 40 and the result would be the entire assembly would slide upward in the casing and setting could not be achieved.

The provision of pins 30 in a single close-fitting hole in the gripping member 13 allows instantaneous pivoting of member 13 into the casing wall and an anchoring effect of the upper slip assembly prior to the engagement of collet fingers 43 on sleeve 40. By making pins 30 shearable, the carrier sleeve 12 is thus merely frangibly attached to gripping member 13 and upon unsetting of the packer, shearing of pins 30 is achieved. When unsetting is desired, sleeve 12 is then slidable inside gripping member 13 and unsetting lug 31 can be moved into abutment in the gripping member slot 32 to rotate the member out of engagement with the casing wall.

Thus, it can be seen that the advantages of the mechanical packer of the second embodiment includes the taking up of the packer in response to forces in both directions arising from the latching collet sleeve 43 and also the preset indicator function comprising the early rotation of the upper gripping member into engagement in the well casing prior to beginning the irreversible setting steps for the entire packer assembly.

Figure 3A:
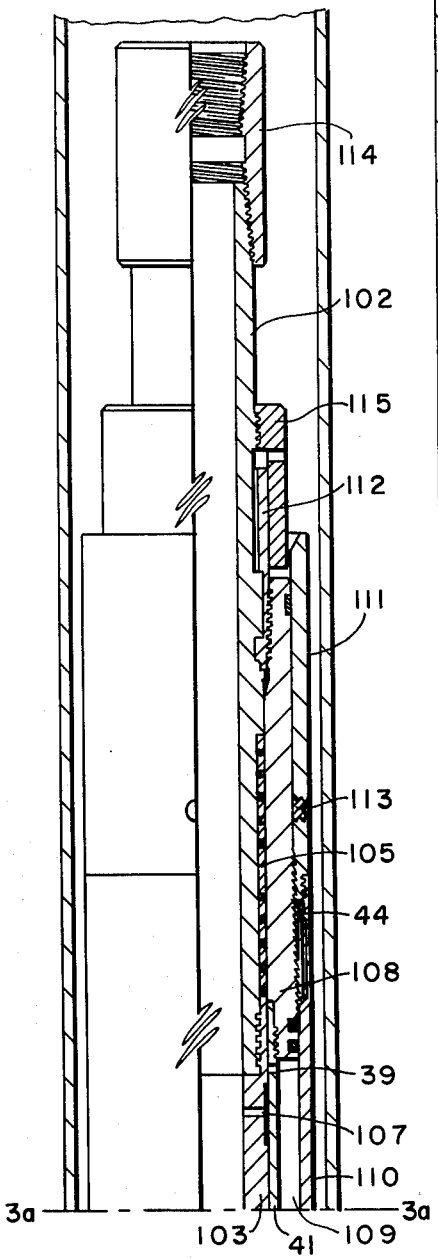
FIG. 3 is a partial cross-sectional illustration of the packer set in the well casing and in the hydraulic setting mode.
Figure 3B:
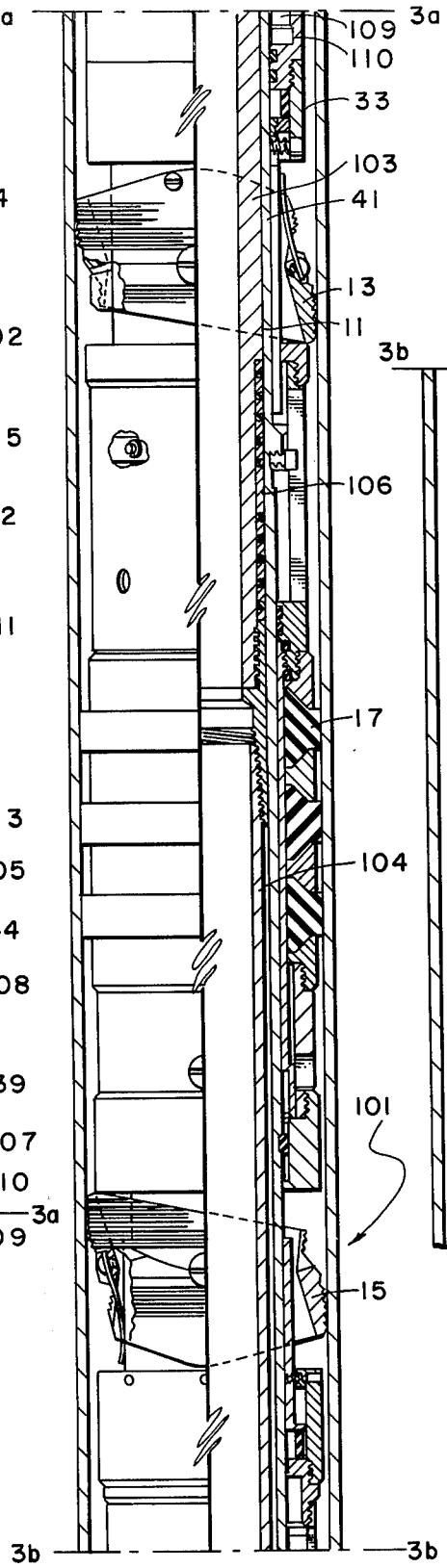
Figure 3C:
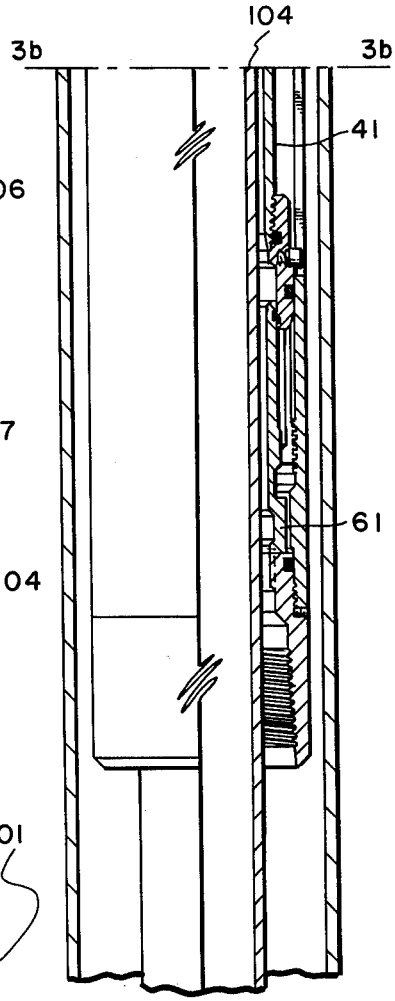

FIG. 3 illustrates a third embodiment of the invention comprising a hydraulically actuated packer assembly 101 having similar advantages as described above with respect to the first two embodiments. The general operation and construction of packer 101 is substantially similar to that of the first two embodiments with the exception of the elements located above slip abutment collar 33.

A tubular hydraulic cylinder assembly is threadedly attached to collar 33 and generally comprises a main hydraulic cylinder 110 to which is attached at the top an upper housing 111. The spring collet sleeve 44 is held between housing 111 and cylinder 110. An annular hydraulic actuation chamber 109 is formed between hydraulic cylinder 110, packer mandrel 11, and a piston sleeve 108 threadedly attached to the top of mandrel 11.

A hydraulic setting tool comprising an upper hydraulic mandrel 102 threadedly connected to a lower hydraulic mandrel 103 with external packing seals 105 is threadedly connected by collar 114 to the bottom end of a tubing string. The hydraulic setting tool extends in sealing engagement through the upper portion of mandrel 11 and piston sleeve 108. An elongated tubular extension tube 104 is threadedly connected to the lower end of lower mandrel 103 and extends downward through the bottom end of the well packer. Preferably the retrieving tool disclosed in FIG. 2 is located at the lower end of the extension tube for engagement with retrieval mandrel 61 when it is desirable to unset the packer.

A locking sleeve 112 is threadably engaged in piston sleeve 108 and further is in abutment with a matching inner channel on the upper mandrel 102 thereby securing sleeve 108 to mandrel 102. Likewise, an abutment collar 115 is threadedly attached to mandrel 102 extending downwardly over locking sleeve 112.

In typical operation, the hydraulic setting assembly comprising the upper and lower mandrels and the extension tube is placed inside the well packer assembly in sealing engagement therein. The two assemblies are connected to the lower end of the tubing string and lowered into the well bore to the proper depth for isolating the desired formation. A sealing plug or ball is then dropped through the tubing string to a seat therein located below a port 107 which is formed through the wall of the lower mandrel 103.

Hydraulic pressure is then applied to the tubing string and reacts through ports 107 and 39 against the lower end of hydraulic cylinder 110. This results in driving the upper slip assembly downward with respect to the inner mandrel assembly 11 which causes abutment of the two gripping members in telescoping engagement therebetween and a radial expansion of sealing element 17 as previously described with respect to the telescoping movement of these assemblies.

Hydraulic pressure is continued on the tubing until total telescoping inward movement between the upper and lower slip assemblies has been accomplished thereby obtaining full radial expansion of the sealing elements and full gripping engagement of the gripping members 13 and 15 in the casing. The action of latching collar 44 on matching external teeth formed on piston sleeve 108 locks the well packer in the set position as illustrated in FIG. 3. After setting the packer, the pressure is released on the tubing string. Retrieval can be accomplished through the previously described process by upward sliding movement of retrieval mandrel 61.

Thus, it can be seen from the description of embodiment 3 that the packer is designed to take up in both directions through the provision of locking collet sleeve 44 and matching teeth formed on piston sleeve 108. Likewise, full retrieval capabilities of the packer are provided as described previously.

Although a specific preferred embodiment of the present invention has been described in the detailed description above, the description is not intended to limit the invention to the particular forms or embodiments disclosed therein since they are to be recognized as illustrative rather than restrictive and it will be obvious to those skilled in the art that the invention is not so limited. All modifications and changes are deemed to be embraced by the spirit and scope of the invention except as the same may be necessarily limited by the appended claims or reasonable equivalents thereof.

The embodiments of an invention in which an exclusive property or privilege is claimed are defined as follows:

1. A well packer for sealing and gripping engagement in a well bore, said packer comprising:

an elongated inner tubular mandrel assembly extending substantially the length of said well packer;

a tubular upper slip assembly having a unitary tubular pivotable gripping member located thereon in encircling relationship, said upper slip assembly being arranged for telescopic movement of said mandrel assembly and said upper slip assembly being frangibly and pivotally attached to said tubular mandrel assembly;

a tubular upper packer assembly slidably located on said mandrel assembly below said upper slip assembly, having resilient annular packer means located slidably thereon, and arranged for abutment with said upper slip assembly;

a tubular lower packer assembly slidably located on said mandrel assembly in abutment with said upper packer assembly;

a tubular lower slip assembly having a unitary tubular pivotable gripping member located therearound, and arranged for telescopic sliding movement on said mandrel assembly into abutment with said lower packer assembly;

a locking collar assembly releasably securing said lower slip assembly to said mandrel assembly; and take-up latching means between said upper slip assembly and said mandrel assembly and arranged to allow telescopic movement therebetween in one relative longitudinal direction while preventing telescopic movement therebetween in the opposite direction;

said well packer is adapted to be set by engaging a wireline setting tool with the upper end portion of said mandrel assembly, such that actuating the wireline setting tool causes said mandrel to be moved upward, said upper slip assembly to be moved downward into abutment with said upper packer assembly and rotated to engage said well bore, said lower slip assembly to be moved upward, said resilient annular packer means to be engaged with said well bore, said take-up latching means to be engaged, and said lower slip assembly to be positioned for gripping the interior of said well bore; and said well packer is adapted to be released by engaging a retrieval tool with said locking collar assembly thereby releasing said lower slip from said mandrel assembly, shearing the frangible attachment between said upper slip assembly and said mandrel assembly thus permitting upward movement of said upper slip assembly from abutting position with said upper packer and pivoting movement of said upper slip assembly, telescopic rotation of said mandrel means, release of said resilient annular packer means, and release of said lower slip assembly.

2. The well packer of claim 1 further comprising a pair of shearable pivot pins frangibly and pivotally attaching said upper gripping member to said upper slip assembly.

3. The well packer of claim 1 wherein said latching means comprises a ratchet-toothed collet sleeve held in said upper slip assembly and a complementary ratchet-toothed section formed on said mandrel assembly arranged for ratcheting engagement with said toothed collet sleeve.

4. The well packer of claim 1 wherein said upper slip assembly and inner mandrel assembly further comprise hydraulic cylinder means adapted to receive pressurized hydraulic fluid and in response thereto to telescope said upper slip assembly on said mandrel assembly toward said lower slip assembly.

5. The well packer of claim 4 further comprising tubular means sealingly engaged in said mandrel assembly and having fluid port means communicating with said hydraulic cylinder means.

6. The well packer of claim 1 wherein said locking collar assembly comprises a spring collet sleeve secured to the bottom of said mandrel assembly and having shouldered spring fingers extending axially therefrom; an internal locking channel formed in said lower slip assembly and adapted to receive said shouldered spring fingers in locking relationship therein; and a locking sleeve frangibly attached to the inside of said mandrel assembly, arranged to maintain said spring fingers engaged in said locking channel, and adapted to be moved out of locking arrangement with said spring fingers upon shearing of said frangible attachment.

7. The well packer of claim 3 further comprising mechanical setting means having a setting mandrel assembly connected to said inner mandrel assembly and adapted for connection to a tubing string; and, a friction assembly slidably located on said setting mandrel assembly, adapted to engage a well bore casing with sliding friction, and arranged for abutment with said upper slip assembly.

8. A well bore packer for sealing and gripping a cased well bore, said packer comprising:

an elongated tubular inner mandrel assembly extending through a substantial portion of the well packer;

an upper cylindrical tubular slip carrier assembly located slidably on said inner mandrel assembly and arranged for limited longitudinal sliding movement thereon;

an upper tubular gripping member encircling a portion of said upper carrier assembly and arranged for partial pivotal rotation thereon, said gripping member having toothed means adapted to be pivoted radially outward into gripping engagement with a well casing;

a tubular upper packer assembly slidably mounted on said inner mandrel assembly below said upper carrier assembly and having peripheral elastomeric sealing elements located thereon;

a tubular lower packer assembly slidably mounted on said inner mandrel assembly below said sealing elements and slidably connected to a bottom portion of said upper packer assembly;

a lower tubular slip carrier assembly located slidably on said inner mandrel assembly and arranged for abutment with said lower packer assembly;

a lower tubular gripping member pivotally located around said lower slip carrier assembly;

a releasable locking collar connecting said lower slip carrier assembly to said inner mandrel assembly; and a ratcheting lock assembly between said inner mandrel assembly and said upper slip carrier assembly including a downwardly projecting plurality of latch teeth around an upper end portion of said inner mandrel assembly, a collar around said upper end portion of said mandrel assembly having a continuous annular collet mounted therein with a plurality of inwardly and upwardly projecting fingers which are adapted to operably engage said latch teeth upon movement of the upper end portion of said mandrel substantially into said collar in order to allow downward relative movement of said upper slip carrier assembly with respect to said inner mandrel assembly while preventing relative upward movement therebetween.

9. A well bore packer comprising:

elongated tubular inner mandrel means having connection means at the top end;

telescoping housing means located on said inner mandrel means;

tubular pivotable gripping means encircling said housing means and adapted to be pivoted into gripping engagement in a well bore;

elastomeric annular sealing means on said housing for selective sealing engagement in a well bore;

said telescoping housing means having means thereon for longitudinally compressing said sealing means into sealing engagement with the well bore;

selectively operable locking means connecting said inner mandrel means to a portion of said telescoping housing means; and ratcheting latch means between said inner mandrel means and a portion of said telescoping housing means having helical teeth on said mandrel and cooperatively engageable helical teeth in a segmented and inwardly biased collet sleeve on said housing and a stop ring on said mandrel, and arranged to allow limited telescoping of said housing means in either axial direction between said stop ring and said helical mandrel teeth for positioning the packer within the well bore prior to setting and unlimited telescoping of said housing means in the contractive axial direction for setting the packer.

10. The well bore packer of claim 9 wherein said ratcheting latch means comprises a plurality of wedge-shaped teeth on said mandrel means and a spring collet sleeve having complementary wedge-shaped teeth formed therein, said spring collet sleeve being attached to said housing means and encircling said mandrel means.

11. A well packer for sealing and gripping engagement in a well bore, said packer comprising:

an elongated inner tubular mandrel assembly extending substantially the length of said well packer;

a tubular upper slip assembly having a unitary tubular pivotable gripping member located thereon in encircling relationship, said upper slip assembly being arranged for telescopic movement on said mandrel assembly and being frangibly and pivotally attached thereto by a pair of shearable pivot pins;

a tubular upper packer assembly slidably located on said mandrel assembly below said upper slip assembly, having resilient annular packer means located slidably thereon, and arranged for abutment with said upper slip assembly;

a tubular lower packer assembly slidably located on said mandrel assembly in abutment with said upper packer assembly;

a tubular lower slip assembly having a unitary tubular pivotable gripping member located therearound, and arranged for telescopic sliding movement on said mandrel assembly into abutment with said lower packer assembly;

a locking collar assembly releasably securing said lower slip assembly to said mandrel assembly; and take-up latching means between said upper slip assembly and said mandrel assembly and arranged to allow telescopic movement therebetween in one relative longitudinal direction while preventing telescopic movement therebetween in the opposite direction.

* * * * *